US005187409A

United States Patent [19]

Ito

[11] Patent Number: 5,187,409

[45] Date of Patent: Feb. 16, 1993

[54] GYROTRON HAVING A QUASI-OPTICAL MODE CONVERTER

[75] Inventor: Yasuyuki Ito, Yokohama, Japan

[73] Assignee: Kabushiki Kaisha Toshiba, Kawasaki, Japan

[21] Appl. No.: 673,401

[22] Filed: Mar. 22, 1991

[30] Foreign Application Priority Data

Mar. 26, 1990 [JP] Japan ..... 2-73274

[51] Int. Cl.[5] ..... H01J 23/40

[52] U.S. Cl. ..... 315/5; 333/21 R; 331/79

[58] Field of Search ..... 315/4, 5, 39; 333/227, 333/21 R; 331/79, 91

[56] References Cited

U.S. PATENT DOCUMENTS

| | | | |
|---|---|---|---|
| 4,189,660 | 2/1980 | Dandl | 315/5 X |
| 4,636,688 | 1/1987 | Ito | 315/5 X |
| 4,636,689 | 1/1987 | Moorier | 315/5 X |
| 4,839,561 | 6/1989 | Ito | 315/5 X |
| 5,030,929 | 7/1991 | Moeller | 333/21 R |
| 5,043,629 | 8/1991 | Doane | 315/5 |

FOREIGN PATENT DOCUMENTS

| | | | |
|---|---|---|---|
| 195840 | 10/1985 | Japan | 315/5 |
| 128523 | 6/1988 | Japan | 315/4 |
| 980555 | 5/1986 | U.S.S.R. | 315/4 |

OTHER PUBLICATIONS

L. Rebuffi et al, "A Beam Rectifier Antenna System", 14th International Conference on Infrared and Millimeter Waves, Conference Digest, p. 394 (1989).

M. Thumm et al "In-Waveguide TE01-to-Whispering Gallery Mode Conversion Using Periodic Wall Perturbations", 13th International Conference on Infrared and Millimeter Waves, pp. 465-466 (1988).

S. N. Vlasov, et al, "Transformation of a Whispering Gallery Mode, Propagating in a Circular Waveguide, into a Beam of Waves", Engineering and Electronic Physics, pp. 14-17 (1974).

B. W. Stallard et al, "Magictrac, A Novel Method for Conversion of Whispering Gallery Modes into a Free-Space Gaussian-like Beam", International Journal of Infrared and Millimeter Waves, vol. 11, (1990) pp. 1011-1032.

*Primary Examiner*—Paul M. Dzierzynski
*Assistant Examiner*—Benny T. Lee
*Attorney, Agent, or Firm*—Oblon, Spivak, McClelland, Maier & Neustadt

[57] ABSTRACT

A gyrotron having a mode converter located in the path of a wave passing passage, the mode converter comprising a means for mode-converting electromagnetic wave into a radiating electromagnetic wave having an annular-shaped power distribution in a plane perpendicular to the direction in which the electromagnetic wave propagates, a ring-shaped mirror (annular mirror) for reflecting the radiating electromagnetic wave which has been converted by the mode converting means, and a waveguide tube having a kerf (i.e., a cutting portion of the tube) opposed to the annular mirror to receive the electromagnetic wave reflected by the annular mirror.

14 Claims, 5 Drawing Sheets

GYROTRON HAVING A QUASI-OPTICAL MODE CONVERTER

BACKGROUND OF THE INVENTION

1. Field of the Invention

The present invention relates to a gyrotron having a mode converter in the waveguide.

2. Description of the Related Art

There are various means for heating plasma in a fusion reactor. One of them is electron-cyclotron resonance heating by super high-power millimeterwaves. This plasma heating calls for high power oscillators with a frequency at the band of millimeter waves. The gyrotron is deemed promising as this oscillator.

In a case where an output wave of the gyrotron is practically used to heat core plasma in the fusion reactor, the gyrotron is often separated from the core plasma by considerable distance. It is thus necessary that the output wave mode of the gyrotron is converted into $TE_{01}$ mode which is smaller in transmission loss and that the wave thus converted in a $TE_{01}$ mode is transmitted to the core plasma through a circular waveguide.

This is the reason why attention has been paid to a system disclosed in a below-cited reference (1) and including a mode converter which is located on the way of waveguide passage in a circular waveguide and which is formed by a circular waveguide provided with periodic perturbations to convert the output wave oscillated under the $TE_{mn}$ mode into that of the $TE_{01}$ mode.

Reference (1): M. Thumm, et al. "In-Waveguide $TE_{01}$-To-Whispering Gallery Mode Conversion Using Periodic Wall Perturbations"

Recently, however, millimeter waves higher in frequency and larger in power are needed. The gyrotron of such a large power type that can meet this need oscillates millimeter waves under that mode which is $m >> 1$, $n \sim 1$ under the $TE_{mn}$ mode and which is called the whispering gallery mode. It is difficult in this case to convert the output wave of this mode directly into that of the $TE_{01}$ mode by using the mode converter disclosed in the reference (1).

In the case of the output wave of this whispering gallery mode, the output wave propagated through the circular waveguide tube is radiated like a beam into free space by the Vlasov launcher and this radiated wave is transmitted while being successively reflected and focused by plural curved mirrors, as disclosed in a below-cited reference (2). A system in which focused electromagnetic wave is entered into and transmitted in a waveguide provided with rows of grooves on the inner face in the circumferential direction thereof has been produced. This is a tube which is called a corrugated waveguide tube.

Reference (2): S.N. Vlasov, et al. "Transformation Of A Whispering Gallery Mode, Propagating In A Circular Waveguide, Into A Beam Of Waves".

In short, the mode converter is formed by the Vlasov launcher and the curved mirrors.

In the case of the waveguide passage formed as described above, however, high processing accuracy is needed in making the curved mirrors used to transmit the electromagnetic wave, the drive mechanism for adjusting optical axes, the corrugated waveguide tube and the like. The waveguide passage thus formed is therefore higher in cost as compared with the one formed by the circular waveguide tube.

In a case where an electron beam collector for collecting electron beam is used together with the output waveguide tube in the gyrotron of the type which oscillates the output wave under the whispering gallery mode, the electron beam collector cannot resist thermal loading when the gyrotron is made to have a larger output. It has therefore been considered that the mode converter disclosed in the reference (2) is housed in this gyrotron, as shown in FIG. 7, to separate the electron beam collector from the output waveguide so as to make it possible to use a larger-sized electron beam collector.

According to this gyrotron, a gyrating electron beam shot from an electron gun enters into and is oscillated in a cavity resonator. Electromagnetic wave thus generated in the resonator is transmitted into a mode converter, which comprises the Vlasov radiator and the curved mirror, through the circular waveguide tube connected to the resonator. This electromagnetic wave is reflected by a reflecting mirror in a direction right-angled relative to the center axis of the cavity resonator and then sent as output electromagnetic wave through an output window. FIG. 7 illustrates a mode converter 6, an electron gun 11, an electron beam 12, a circular waveguide 13, a Vlasov mode converter 14, a mirror 15, a window 16, and a gyrated output wave 17. Reference numeral 18 in FIG. 7 denotes electromagnets for adding magnetic field needed to generate the gyrating electron beam, electromagnets 19 for adding magnetic field needed for oscillation, and a collector 20 for collecting electron beam.

In the case of the gyrotron having the above-described arrangement, however, the mode converter 6 comprising the Vlasov converter 4 and the flat or curved mirror 5 is housed in the gyrotron. This makes the gyrotron complicated in structure and damages the axisymmetry of the gyrotron structure. In addition, reliability is reduced relative to the output wave transmitting axis in the gyrotron.

The electromagnetic wave of the whispering gallery mode is hard to transmit with low loss to an intended position through the conventional waveguide passage. Further, when the electromagnetic wave of the whispering gallery mode is to be converted into that of the $TE_{01}$ mode in the conventional gyrotron and to be outputted through the gyrotron, the whole of the gyrotron also becomes complicated.

SUMMARY OF THE INVENTION

The object of the present invention is therefore to provide a gyrotron having a mode converter on the waveguide passage to eliminate the above-mentioned drawbacks and, more particularly, a gyrotron capable of realizing a higher output and a higher efficiency without making the gyrotron complicated in structure.

This object of the present invention can be achieved by a gyrotron having a mode converter on the waveguide passage, said mode converter comprising a means for converting electromagnetic wave into a radiating electromagnetic wave which has an annular-shaped power distribution in a plane perpendicular to the direction in which the electromagnetic wave propagates, an annular mirror for reflecting the radiation electromagnetic wave thus converted by the converting means, and a waveguide having a kerf (i.e., a cutting portion of a waveguide tube) opposed to the annular mirror to receive the radiation electromagnetic wave reflected by the annular mirror.

According to the gyrotron having the above-described arrangement, the shape of the reflecting surface of the annular mirror and the position and shape of the waveguide whose kerf is opposed to the annular mirror may only be selected to make it possible to convert the electromagnetic wave of the whispering gallery mode ($TE_{mn}$, $m>>1$, $n\sim1$), for example, into that of other waveguide modes such as the $TE_{01}$ mode and to transmit it through the gyrotron.

It is opposed that the electromagnetic wave radiated from the straight cut of the circular waveguide is a superposition of plane waves. Therefore, the wave vector (k) of this plane wave relative to the $TE_{mn}$ mode can be substantially obtained in the cylindrical coordinate system from the following equation.

$$k=(k_r, k_\theta, k_z) \quad (1)$$

wherein $k_r=[(x_{mn}/a)^2-(m/a)^2]^{\frac{1}{2}}$, $k_\theta=m/a$, $k_z=[k^2-(x_{mn}/a)^2]^{\frac{1}{2}}$ and $k=2\pi/\lambda$ and where $\lambda$: the wavelength in free space, $\pi$: pi, Xmn: the n-th root of derivative of m-th order Bessel function of the first kind, m: the azimuthal mode number of wave in the waveguide, a: the waveguide radius.

Particularly when the electromagnetic wave of the whispering gallery mode ($m>>1$, $n\sim1$) is radiated from the circular waveguide cut (known as a kerf, which means an aperture), it becomes a radiated electromagnetic wave having an annular-shaped power distribution in a sectional plane perpendicular to the tube axis.

Providing that the desired mode of wave wanted to obtain after the conversion is $TE_{mn}$, the wave vector (k') of the plane waves superposed can be expressed as follows.

$$k'=(k_4', k_\theta', k_z') \quad (2)$$

wherein $k_r'=[(x_{m'n'}/a)^2-(m'/a')^2]^{\frac{1}{2}}$, $k_\theta'=m'/a'$, and $k_z'=[(k^2-(x_{m'n'}/a)^2]^{\frac{1}{2}}$. ($m'=1, 2, \ldots N'=1, 2, \ldots$).

The electromagnetic waves radiated from the circular waveguide cut portion can be transmitted by reflecting with an appropriate annular mirror. Further, when the wave vector is changed from (k) obtained by the equation (1) to (k') obtained by the equation (2) on reflecting the electromagnetic wave by the annular mirror, most of the power of the $TE_{mn}$ mode can be converted into that of $TE_{m'n'}$ mode.

The present invention is based on the above-described fundamental theory. When the mode converter having the above-described arrangement is located on the waveguide passage, therefore, the electromagnetic wave of the whispering gallery mode ca be converted directly into that of the $TE_{01}$ mode. As the result, the waveguide passage thus formed can be smaller in transmission loss and simpler in structure.

Further, the gyrotron in which the mode converter having the above-described arrangement is housed allows the electron beam collector to be separated from the output wave transmitting passage in the gyrotron without making the gyrotron complicated in structure and damaging the axisymmetry of the gyrotron structure. The electron beam collector can be thus made larger in size. This enables the gyrotron to have a larger output. Still further, an electrode for converting the kinetic energy of the electron beam to electric energy can be used to thereby increase the oscillation efficiency of the gyrotron to a greater extent.

Additional objects and advantages of the invention will be set forth in the description which follows, and in part will be obvious from the description, or may be learned by practice of the invention. The objects and advantages of the invention may be realized and obtained by means of the structures and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
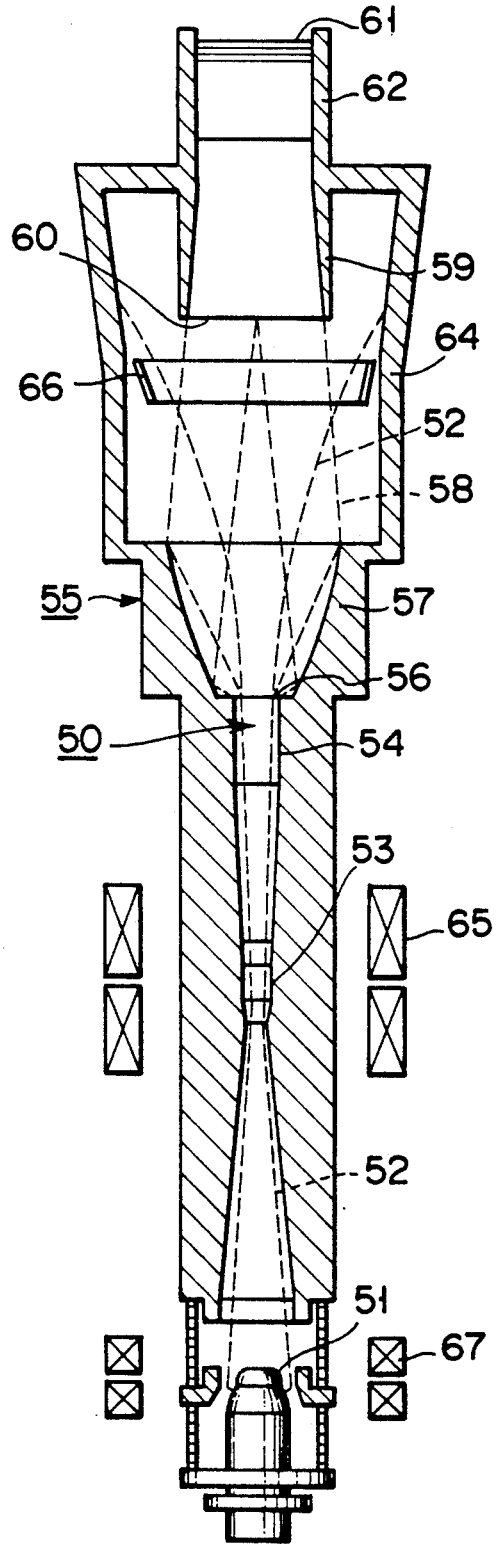
FIG. 1 is a sectional view showing an arrangement of the waveguide passage formed according to an embodiment of the present invention.

FIG. 1 shows the gyrotron provided with a mode converter 55 which will be described later according to an embodiment of the present invention.

This gyrotron is of such type that oscillate under whispering gallery mode. Reference numeral 50 illustrates a waveguide having a mode converter. More specifically, gyrating electron beam 52 produced by an electron gun 51 is injected into a cavity resonator 53 to oscillated electromagnetic waves in it. Electromagnetic wave of the whispering gallery mode created by the resonator 53 is transmitted into a mode converter 55 through a circular waveguide 54 which is connected to the resonator 53.

Figure 2:
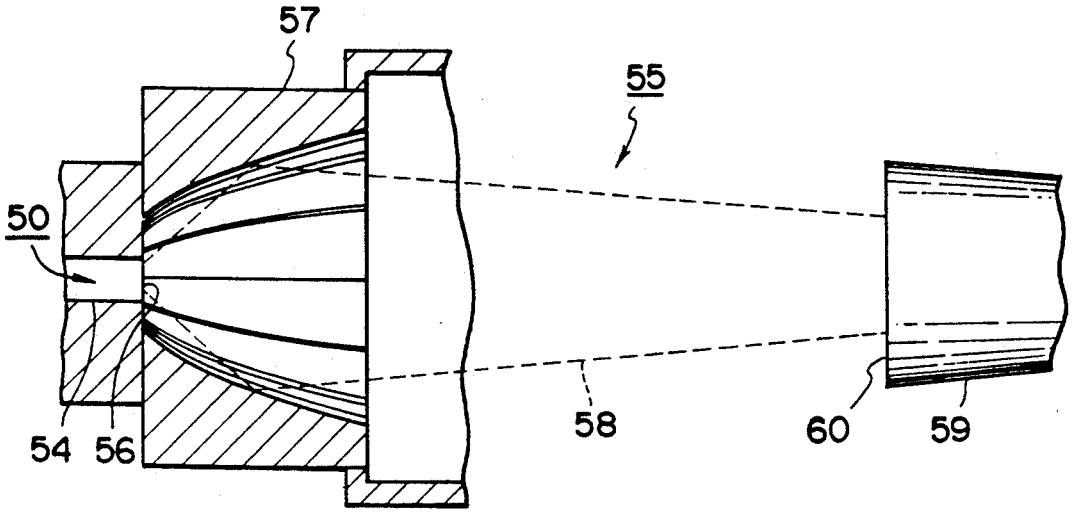
FIG. 2 is a view showing main components partly sectioned by which the waveguide passage is formed.

The mode converter 55 includes a section which is shown in detail in FIG. 2. Namely, radiation wave radiated from a straight cut 56 of the circular waveguide 54 and having an annular-shaped power distribution in a plane perpendicular to the direction in which the radiation wave propagates is made incident on a non-axisymmetric annular mirror 57 which contributes to mode conversion, and its reflected waves 58 are introduced into a cut 60 of a tapered circular waveguide 59.

As seen in FIG. 1, the tapered circular waveguide 59 is smoothly connected to a linear circular waveguide 62 to which an output window 61 is attached. An electron beam collector 64 which serves to collect spent electron beam is arranged between and around the annular mirror 57 and the tapered circular waveguide 59. This electron beam collector 64 is cooled by a cooling system (not shown). The electron beam is introduced to the electron beam collector 64 by magnetic flux produced by superconducting magnets 65. The shape of the magnetic flux may be adjusted by additional super- or normal-conducting magnets located adjacent to the electron beam collector 64. Instead of the electron beam collector 64 located between the annular mirror 57 and the tapered circular waveguide 59, at least one annular electrode 66 may be used. By adding appropriate potential to the electrode 66, the spent electron beam can be collected with to directly recover its kinetic energy.

An electromagnetic wave absorbing layer mode of silicon carbide material or formed by the chemical vapor deposition film of silicon carbide may be formed on a part or all of the inner surface of the structure which supports the circular waveguide tube 50, the annular mirror 57 and the tapered circular waveguide 59. Reference numeral 67 in FIG. 1 denotes electromagnets for adding magnetic field to produce the gyrating electron beam In the case of the gyrotron having the above-described arrangement, output wave of the gyrotron which oscillates electron beam under the whispering gallery mode is converted into that of $TE_{01}$ mode, which can be easily transmitted, by the mode converter 55 in the gyrotron and then outputted.

Since the above-described mode converter 55 is incorporated into the gyrotron in this case, the gyrotron is less complicated in structure. Further, the electron beam collector 64 can be separated from the output wave transmitting path in the gyrotron without damaging the axisymmetry of the gyrotron structure. Therefore, the electron beam collector 64 can be enlarged, thereby enabling the output of the gyrotron to be made higher. Still further, the electrode 66 which serves as a potential depressed collector to convert the kinetic energy of the electron beam 52 to electrical energy can be used. This enables the oscillation efficiency of the gyrotron to be increased to a greater extent.

The output window 61 may be located between the annular mirror 57 and the tapered circular wave guide 59 or at an optional position in the tapered circular waveguide 59. Or it may be located adjacent to the kerf 60 of the tapered circular waveguide 59, which is large in sectional area, in order to make thermal load small. A tapered circular coaxial waveguide tube 42 shown in FIG. 4 may be used instead of the tapered circular waveguide tube 59.

Figure 3A:
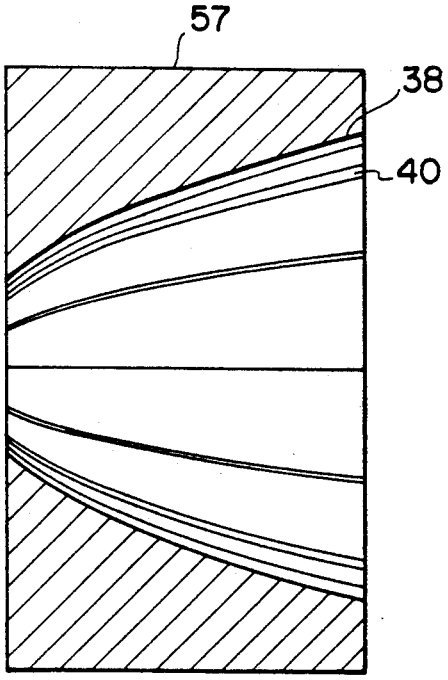
FIG. 3A is a sectional view taken along a line X—X in FIG. 3B.
Figure 3B:
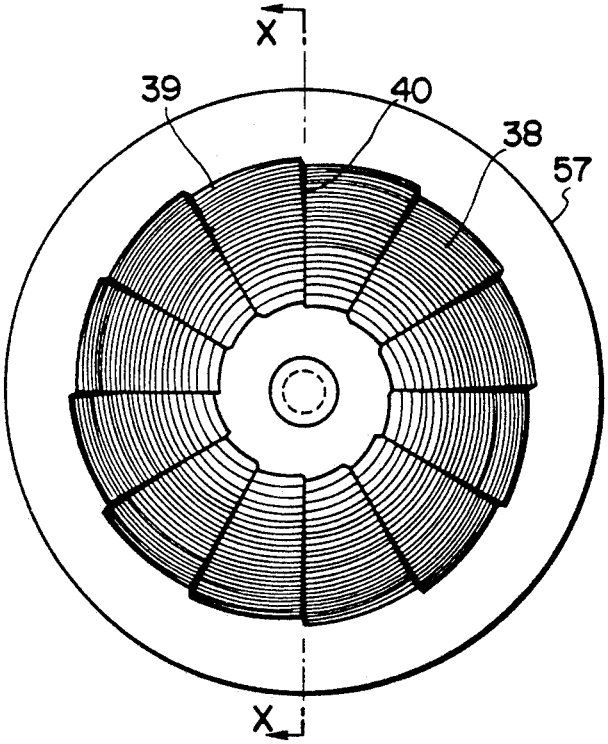
FIG. 3B is a view showing an annular mirror located on the waveguide passage.

FIG. 2 partly shows the mode converter 55 according to an embodiment of the present invention in which the waveguide 50 is included. FIGS. 3A and 3B are sectional and front views showing in a enlarged scale the annular mirror 57 which can be a characteristic of the present invention. The characteristic shape of this mirror 57 is apparent from FIGS. 3A and 3B.

This waveguide 50 has the mode converter 55 in a portion between the annular mirror 57 and the kerf 60 and it is arranged to convert electromagnetic wave of $TE_{12}$, mode which is one of the whispering gallery modes into that of $TE_{01}$ mode by means of the mode converter 55 and then transmit the electromagnetic wave of $TE_{01}$ mode thus converted.

The mode converter 55 is arranged in such a way that the circular waveguide 54 which guides the electromagnetic wave of $TE_{12}$, 2 mode is provided with the kerf 56, that electromagnetic wave radiated from the kerf 56 is reflected by the annular mirror 5 located coaxial to the waveguide 54, and that the electromagnetic wave thus reflected is entered into the kerf 60 of the tapered circular waveguide 59.

As shown in FIGS. 3A and 3B, the annular mirror 57 has a non-axisymmetrical concave mirror 38 on the inner surface thereof. This concave mirror 38 is divided into twelve parts 39, same as the azimuthal mode number of input electromagnetic wave, so as to periodically change in the azimuthal direction of the mirror and a step 40 is formed at the border of each of the divided reflecting parts 39 of the mirror 38 with its adjacent one. Namely, the number of the periodic changes in the azimuthal direction is set the same as the number index (m) of the azimuthal direction modes which is defined at the time when the electromagnetic field distribution of the input electromagnetic wave has a factor of exp $(\pm\sqrt{-1}m\theta)$ in the cylindrical coordinate system (r, $\theta$, z). Each of the divided reflecting parts 39 is formed to have such a curved surface that smoothly changes in the axial direction as well as in the azimuthal direction.

The concave mirror 38 is formed in such a way that the unit normal vector erected from the divided reflecting part 39 can meet the following requisite.

Figure 4:
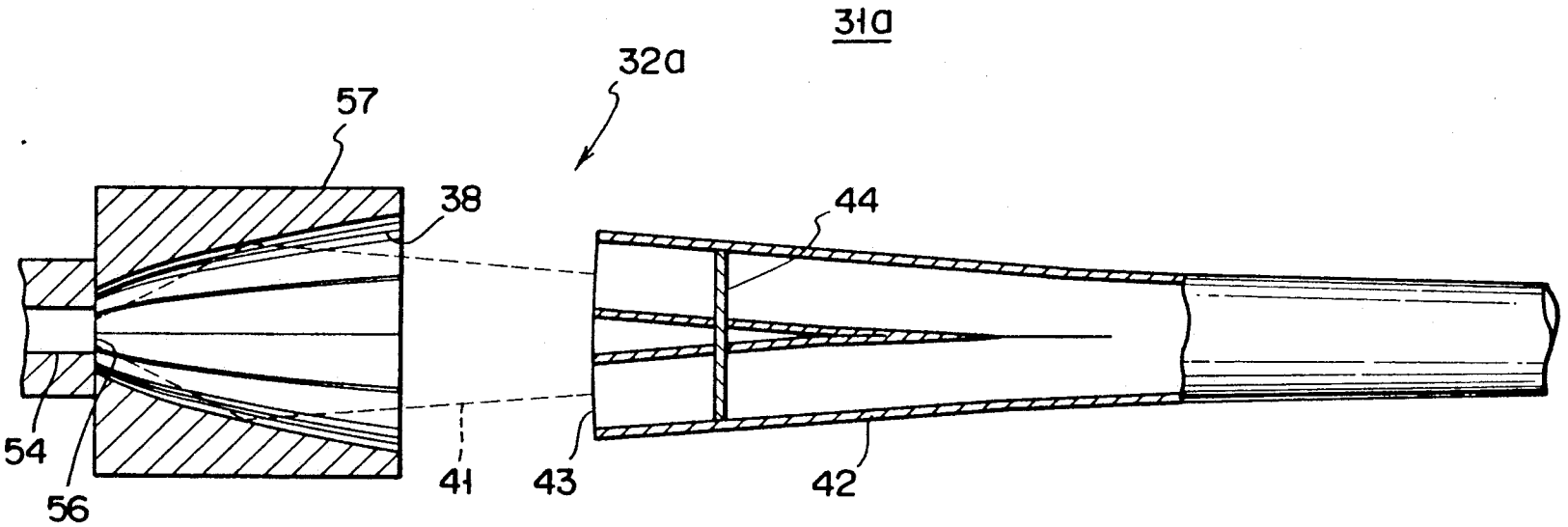
FIG. 4 is a sectional view showing an arrangement of the waveguide passage formed according to another embodiment of the present invention.

The unit wave vector (k) of the electromagnetic wave radiated from the kerf 56 of the circular waveguide 54 is calculated on the annular mirror 57 first. The unit wave vector (k') of wave reflected at each of points on the annular mirror 57 is defined in such a way that the electromagnetic wave reflected by the annular mirror 57 is focused on a point on an optical axis of the electromagnetic wave 41 (FIG. 4) entering into the tapered circular waveguide 59 previously set. FIG. 4 illustrates a waveguide passage 31*a*. In order to convert the mode of the reflected wave into the $TE_{01}$ mode, it is needed that the optical axis 41 is in a (r, z) plane. The unit normal vector can be obtained from the wave vectors k and k' as follows.

$$n=(k\propto -k)/|k'-k|;n\text{: local normal vector.}$$

The particularly shaped concave mirror 38 is formed on the inner surface of the annular mirror 57 on the basis of the unit normal vector thus obtained.

The position, diameter and tapered angle of the kerf 60 of the tapered circular waveguide 59 are set in such a way that the electromagnetic field distribution of the electromagnetic wave reflected by the annular mirror 57 can become closely akin to that of the electromagnetic wave of the $TE_{01}$ mode at the kerf 60.

When the waveguide 50 has the above-described arrangement, the electromagnetic wave of the whispering gallery mode can be converted on the basis of the above-mentioned reasons directly into that of the $TE_{01}$ mode by the mode converter 55. Therefore, a waveguide, simpler in construction, lower in cost and smaller in loss, can be formed.

Although the electromagnetic wave reflected by the non-axisymmetrical annular mirror 5 which contributes to the mode conversion has entered into the tapered circular waveguide 59 in the case of the gyrotron shown in FIG. 1, it may be arranged that the electromagnetic wave reflected by the non-axisymmetrical annular mirror 57 is reflected by one or plural coaxial axisymmetrical annular mirror(s) and then entered into the tapered circular waveguide 59. Alternatively, it may be arranged that the electromagnetic wave radiated from the kerf 56 of the circular waveguide 54 is reflected by one or plural coaxial axisymmetrical annular mirror(s) and then entered into the non-axisymmetrical annular mirror 57 which contributes to the mode conversion, and that its reflected wave is entered into the tapered circular waveguide 59.

Although the mode converter 55 has been interposed between the non-axisymmetrical annular mirror 57 and the kerf 60 of the tapered circular waveguide 59 to allow the electromagnetic wave reflected by the annular mirror 57 to be entered into the kerf 60 of the waveguide 59 in the case of the above-described embodiment of the present invention, a mode converter 32*a* may be interposed between the annular mirror 57 and a kerf 43 of the tapered coaxial circular waveguide 42 to allow the electromagnetic wave reflected by the annular mirror 57 to be entered into the kerf 43 of the waveguide 42, as shown in FIG. 4. Reference numeral 44 in FIG. 4 represents a support member made of ceramics or the like.

Figure 5:
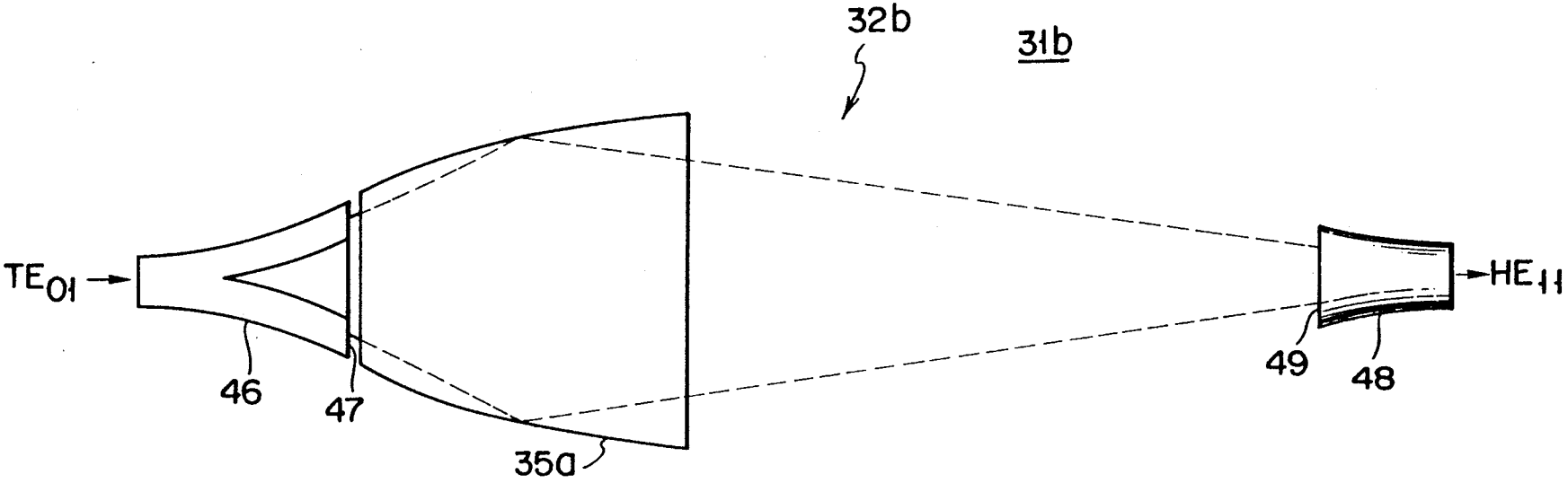
FIG. 5 is a view showing an arrangement of the waveguide passage formed according a further embodiment of the present invention.
Figure 6:
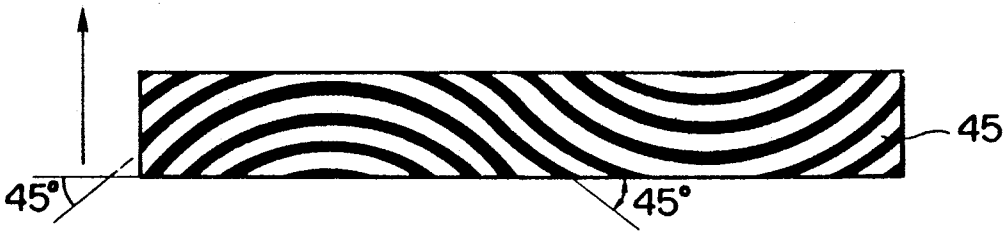
FIG. 6 is a view showing rows of grooves formed on the inner face of the annular mirror.
Figure 7:
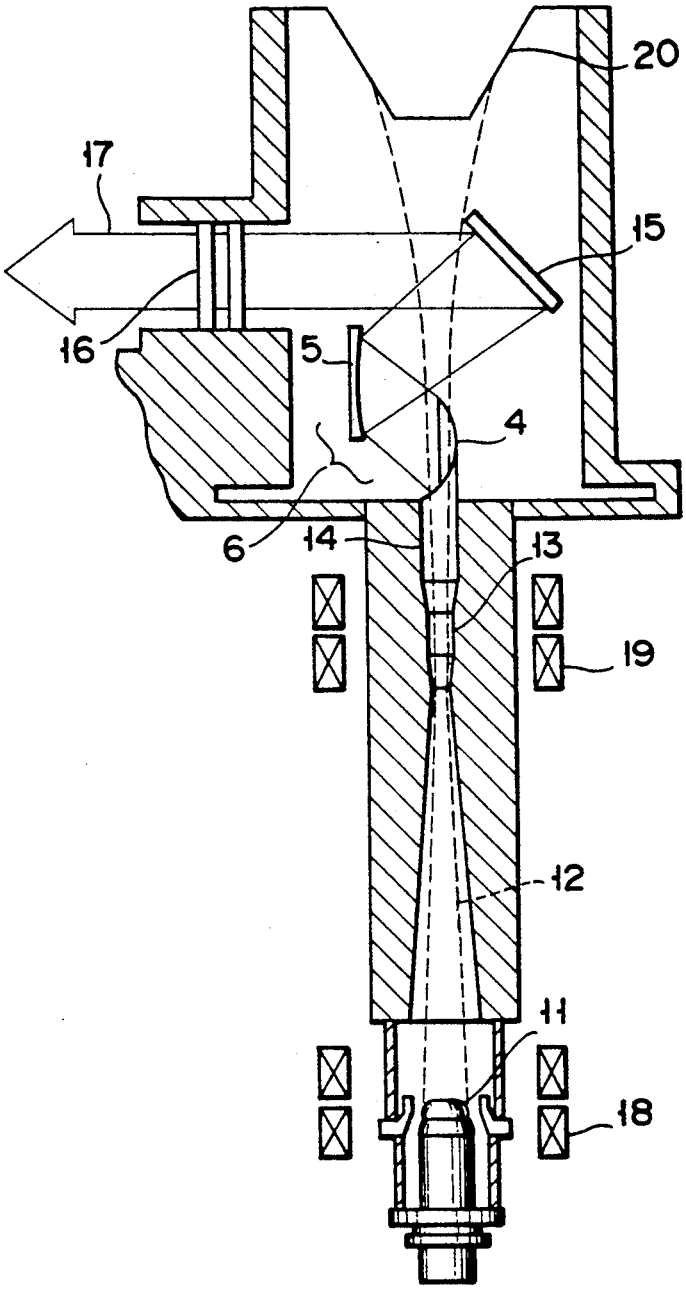
FIG. 7 PRIOR ART
FIG. 7 is a sectional view showing an arrangement of the conventional waveguide.

An annular mirror 35*a* on the inner face of which rows of grooves 45 are formed, as shown in FIG. 6, having a depth of about a quarter wavelength, a pitch smaller than a half wavelength and a width of about a half pitch is used as shown in FIG. 5. In FIG. 5, reference numeral 31*b* illustrates a waveguide passage of a type different from that shown in FIG. 4, and reference numeral 32*b* represents a mode converter. When the gyrotron has this annular mirror 35*a* as shown in FIG. 5, reflected wave can be linearly polarized relative to appropriate input radiation electro-magnetic wave, that is, radiation electromagnetic wave obtained when the electromagnetic wave of the $TE_{01}$ mode is radiated from the kerf of the circular waveguide, or radiation electromagnetic wave obtained when the electromagnetic wave of the $TE_{01}$ mode is introduced into a tapered coaxial waveguide 46 and then radiated from a kerf 47 of the waveguide 46, as shown in FIG. 5, or radiation electromagnetic wave obtained when the electromagnetic wave of the $TE_{01}$ mode is introduced into the mode converter 55 shown in FIG. 2 to produce mixed waves of the $TE_{01}$ and $TE_{02}$ modes and these mixed waves are radiated from the kerf of the circular waveguide connected to the mode converter 55. When the reflected wave is entered into a tapered corrugated waveguide 48 on the inner face of which rows of grooves are formed in the azimuthal direction thereof, or into a kerf 49 of the coaxial waveguide, therefore, its mode can be converted into $HE_{11}$ mode.

According to the gyrotron of the present invention as described above, the electromagnetic wave of the whispering gallery mode can be converted directly into that of the $TE_{01}$ mode which is small in transmission loss. Therefore, the waveguide can be made simpler in construction and lower in cost. In addition, the electromagnetic wave of the $TE_{01}$ mode can be converted into that of other waveguide modes.

Further, when one of the above-described mode converters is located on the wave guiding passage in the gyrotron, the gyrotron cannot become complicated in construction. In addition, the electron beam collector section can be separated from the output wave transmitting passage section in the gyrotron, if necessary, without damaging the axisymmetry of the gyrotron structure. The electron beam collector can be larger-sized, thereby enabling the gyrotron itself to have a larger output. Still further, the electrode which serves to collect a part of the energy of spent electron beam can be arranged in the gyrotron. This enables the gyrotron to have a still larger output and higher efficiency.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A gyrotron including an electron gun for producing an electron beam which is injected into a resonator, said electron beam exciting said resonator to produce an electromagnetic wave, a waveguide coupled to said resonator and through which the electromagnetic wave produced in said resonator propagates, and a mode converter arranged in said waveguide, for converting an output wave mode ($TE_{mn}$ mode) of the electromagnetic wave into a radiated mode electromagnetic wave, said mode converter comprising:

converting means for converting the electromagnetic wave into the radiated mode electromagnetic wave which has an annular-shaped power distribution in a sectional plane perpendicular to an axial direction in which the electromagnetic wave advances;

annular mirror means having a circumferential inner surface for reflecting the radiated mode electromagnetic wave which have been converted by said converting means; and a waveguide tube section located at an end portion of said waveguide and having at an entrance of the waveguide tube section a kerf for receiving the radiated mode electromagnetic wave reflected by said annular mirror means, and said kerf located at a portion spaced apart from said annular mirror means.

2. A gyrotron according to claim 1, wherein said annular mirror circumferential inner surface comprises a plurality of reflecting surfaces which are arranged to periodically change in a circumferential direction.

3. A gyrotron according to claim 2, wherein a number of said reflecting surfaces which periodically change in the circumferential direction is equal to a circumferential mode index (m), defined when an electromagnetic distribution of an input electromagnetic wave being produced and converted has a factor of exp ($\pm\sqrt{-1}\ m\theta$) in a cylindrical coordinate system (r: radius, $\theta$: angle, and z: an axial direction of the waveguide).

4. A gyrotron according to claim 2, wherein said annular mirror means is arranged in such a way that a differential coefficient in an axial direction of said reflecting surfaces is other than zero.

5. A gyrotron according to claim 2, wherein a number of said reflecting surfaces which periodically change in the circumferential direction is equal to a common divisor of a circumferential mode index (m), defined when an electromagnetic distribution of an input electromagnetic wave being produced and converted has a factor of exp ($\pm\sqrt{-1}\ m\theta$) in a cylindrical coordinate system (r: radius, $\theta$: angle, and z: an axial direction of the waveguide).

6. A gyrotron according to claim 2, wherein a number of said reflecting surfaces which periodically change in the circumferential direction is equal to 1.

7. A gyrotron according to claim 1, wherein said waveguide tube is a tapered circular coaxial waveguide.

8. A gyrotron according to claim 7, wherein said waveguide tube is a corrugated waveguide having on an inner face with rows of grooves for anisotropically reflecting the electromagnetic wave.

9. A gyrotron according to claim 1, wherein said annular mirror means has disposed on said circumferential inner surface thereof reflecting surfaces on which rows of grooves for anisotropically reflecting the electromagnetic wave are disposed.

10. A gyrotron according to claim 1, wherein said means for converting, the electromagnetic wave into the radiated mode electromagnetic wave which has an annular power distribution, is a waveguide tube having one of a circular or coaxial form and said kerf located facing an end portion of said annular mirror means.

11. A gyrotron comprising:

an electron gun, a cavity resonator, and mode converting means for converting an electromagnetic wave mode, generated by gyration of an electron beam which is produced when the electron beam is emitted from the electron gun into the cavity resonator, into a radiated electromagnetic wave mode having an annular power distribution in a sectional plane perpendicular to an axial direction in which the electromagnetic wave mode propagates;

annular mirror means for reflecting the radiated electromagnetic wave mode which has been converted by said mode converting means; and said mode converting means including a waveguide tube provided with a kerf which is located at a position spaced apart from said annular mirror means to receive the electromagnetic wave reflected by said annular mirror means.

12. A gyrotron according to claim 11, wherein an electrode is arranged at a predetermined position between said annular mirror means and said waveguide tube to collect said electron beam, said electron beam having a kinetic energy associated therewith which is converted into electrical energy by said electrode.

13. A gyrotron according to claim 11, wherein an electron beam collector for collecting spent electron beams is located at a predetermined position between said annular mirror means and said waveguide tube, with a wave propagating passage provided therebetween.

14. A gyrotron according to claim 11, wherein a layer of wave absorbing matter intended to prevent electromagnetic waves from being reflected is disposed at least on a part of an inner face of a structure which supports said annular mirror means and said waveguide tube.

* * * * *